US012123081B2

(12) United States Patent
Duprez et al.

(10) Patent No.: US 12,123,081 B2
(45) Date of Patent: Oct. 22, 2024

(54) HOT ROLLED STEEL AND A METHOD OF MANUFACTURING THEREOF

(71) Applicant: ArcelorMittal, Luxembourg (LU)

(72) Inventors: Lode Duprez, Gentbrugge (BE); Tom Waterschoot, Lokeren (BE); Nele Van Steenberge, Ghent (BE); Laura Moli Sanchez, Ghent (BE)

(73) Assignee: ArcelorMittal, Luxembourg (LU)

( * ) Notice: Subject to any disclaimer, the term of this patent is extended or adjusted under 35 U.S.C. 154(b) by 607 days.

(21) Appl. No.: 17/413,638

(22) PCT Filed: Dec. 11, 2019

(86) PCT No.: PCT/IB2019/060647
§ 371 (c)(1),
(2) Date: Jun. 14, 2021

(87) PCT Pub. No.: WO2020/128725
PCT Pub. Date: Jun. 25, 2020

(65) Prior Publication Data

US 2022/0074029 A1 Mar. 10, 2022

(30) Foreign Application Priority Data

Dec. 17, 2018 (WO) ..... PCT/IB2018/060185

(51) Int. Cl.

| | |
|---|---|
| ***C22C 38/08*** | (2006.01) |
| ***C21D 8/02*** | (2006.01) |
| ***C21D 9/08*** | (2006.01) |
| ***C21D 9/46*** | (2006.01) |
| ***C22C 38/00*** | (2006.01) |
| ***C22C 38/10*** | (2006.01) |
| ***C22C 38/12*** | (2006.01) |
| ***C22C 38/14*** | (2006.01) |

(52) U.S. Cl.
CPC ..... *C22C 38/08* (2013.01); *C21D 8/0205* (2013.01); *C21D 8/0226* (2013.01); *C21D 9/08* (2013.01); *C21D 9/46* (2013.01); *C22C 38/002* (2013.01); *C22C 38/105* (2013.01); *C22C 38/12* (2013.01); *C22C 38/14* (2013.01)

(58) Field of Classification Search
None
See application file for complete search history.

(56) References Cited

U.S. PATENT DOCUMENTS

| | | | |
|---|---|---|---|
| 4,832,909 | A | 5/1989 | Schmidt et al. |
| 2001/0006081 | A1 | 7/2001 | Uehara et al. |
| 2010/0037994 | A1 | 2/2010 | Das |

FOREIGN PATENT DOCUMENTS

| | | | |
|---|---|---|---|
| CN | 101736140 | A | 6/2010 |
| CN | 105331890 | A | 2/2016 |
| EP | 2840160 | | 2/2015 |
| GB | 1118689 | A | 7/1968 |
| GB | 1142555 | A | 2/1969 |
| JP | S5122616 | A | 2/1976 |
| JP | S5196723 | A | 8/1976 |
| JP | S51117915 | A | 10/1976 |
| JP | S5323818 | A | 3/1978 |
| JP | S 5629623 | A | 3/1981 |
| JP | S 60234920 | A | 11/1985 |
| JP | H07216510 | A | 8/1995 |
| JP | 2004315875 | A | 11/2004 |

OTHER PUBLICATIONS

Michihiko Moriyama et al.:" Influence of Reversion Austenite on Fatigue Property of 18%Ni Maraging Steel," J. Soc. Mat. Sci., Japan), vol. 44, No. 497, pp. 181-186, Feb. 1995, see abstract.
See Search Report of PCT/IB2019/060647 dated Feb. 10, 2020.
Eric A. Jägle et al, "Abstract", Journal of Materials Research, US, (Aug. 19, 2014), vol. 29, No. 17, doi:10.1557/jmr.2014.204, ISSN 0884-2914, pp. 2072-2079.

*Primary Examiner* — Anthony M Liang
(74) *Attorney, Agent, or Firm* — Davidson Kappel LLC

(57) ABSTRACT

A hot rolled steel having a composition including the following elements, expressed in percentage by weight:
15%≤Nickel≤25%
6%≤Cobalt≤12%
2%≤Molybdenum≤6%
0.1%≤Titanium≤1%
0.0001%≤Carbon≤0.03%
0.002%≤Phosphorus≤0.02%
0%≤Sulfur≤0.005%.
0%≤Nitrogen≤0.01%
and can contain one or more of the following optional elements
0%≤Aluminum≤0.1%
0%≤Niobium≤0.1%
0%≤Vanadium≤0.3%
0%≤Copper≤0.5%
0%≤Chromium≤0.5%
the remainder composition being composed of iron and unavoidable impurities caused by processing, the microstructure of said steel sheet comprising in area fraction, 20% to 40% Tempered Martensite, at least 60% of Reverted Austenite and inter-metallic compounds of Molybdenum, Titanium and Nickel.

27 Claims, No Drawings

HOT ROLLED STEEL AND A METHOD OF MANUFACTURING THEREOF

The present invention relates to hot rolled steel suitable for use under a corrosive environment particularly under the sour corrosion found in the oil and gas industry.

BACKGROUND

Oil and gas often are now extracted from deep wells. These deep wells are generally categorized as being either sweet or sour. Sweet wells are mildly corrosive but the sour wells are highly corrosive, due to the presence of corrosive agents, such as hydrogen sulfide, carbon dioxide, chlorides, and free sulfur. The corrosive conditions of sour wells are compounded by high temperatures and high pressures. Hence the extraction of oil or gas from these sour wells becomes very tough. Therefore for sour oil and gas environments, materials are selected to meet stringent criteria for sour corrosion resistance simultaneously having excellent mechanical properties.

Therefore, intense Research and development endeavors are put in to meet the corrosion resistance requirements in a highly toxic and corrosive environment while increasing the strength of material. Conversely, an increase in strength of steel hampers the processing of steel into the products such as seamless pipe, line pipes due to decreases formability, and thus development of materials having both high strengths with formability and adequate corrosion resistance in accordance with standards is necessitated.

Earlier research and developments in the field of high strength and high formability steel with corrosion resistance have resulted in several methods for steel, some of which are enumerated herein for conclusive appreciation of the present invention:

US20100037994 claims for a method of processing a workpiece of maraging steel, comprising receiving a workpiece of maraging steel having a composition comprising 17 wt %-19 wt % of nickel, 8 wt %-12 wt % of cobalt, 3 wt %-5 wt % of molybdenum, 0.2 wt %-1.7 wt % of titanium, 0.15 wt %-0.15 wt % of aluminum, and a balance of iron and that has been subjected to thermomechanical processing at an austenite solutionizing temperature; and directly aging the workpiece of maraging steel at an aging temperature to form precipitates within a microstructure of the workpiece of maraging steel, without any intervening heat treatments between the thermomechanical processing and the direct aging, wherein the thermomechanical processing and the direct aging provide the workpiece of maraging steel with an average ASTM grain size of 10. But US20100037994 does not ensure corrosion resistance and only claims for a method of processing maraging steel economically.

EP2840160 provides a maraging steel excellent in fatigue characteristics, including, in terms of % by mass: C: ≤0.015%, Ni: from 12.0 to 20.0%, Mo: from 3.0 to 6.0%, Co: from 5.0 to 13.0%, Al: from 0.01 to 0.3%, Ti: from 0.2 to 2.0%, O: ≤0.0020%, N: ≤0.0020%, and Zr: from 0.001 to 0.02%, with the balance being Fe and unavoidable impurities. EP2840160 provides adequate strength required but does not provide for a steel that has corrosion resistance against sour corrosion.

SUMMARY OF THE INVENTION

It is an object of the present invention to provide a hot rolled steel that simultaneously has:

- a tensile strength greater than or equal to 1100 MPa and preferably above 1200 MPa,
- a total elongation greater than or equal to 18% and preferably above 19%.
- a sour corrosion resistance and crack free steel according to the NACE TM0177 standards at least 85% of the yield strength load.

In a preferred embodiment, the steel according to the invention may also present a yield strength 850 MPa or more In a preferred embodiment, the steel sheets according to the invention may also present a yield strength to tensile strength ratio of 0.6 or more Preferably, such steel can also have a good suitability for forming, in particular for rolling with good weldability and coatability.

Another object of the present invention is also to make available a method for the manufacturing of these sheets that is compatible with conventional industrial applications while being robust towards manufacturing parameters shifts.

The hot rolled steel sheet of the present invention may optionally be coated to further improve its corrosion resistance.

DETAILED DESCRIPTION

Nickel is present in the steel between 15% and 25%. Nickel is an essential element for the steel of the present invention to impart strength to the steel by forming inter-metallics with Molybdenum and Titanium during the heating before tempering these inter-metallics also acts as the sites for formation of reverted austenite. Nickel also plays a pivotal role in formation of reverted austenite during the tempering which impart the steel with elongation. But Nickel less than 15% will not be able to be able to impart strength due to the decrease in formation of inter-metallics whereas when Nickel is present more than 25% it will form more than 80% reverted austenite which is also detrimental for the tensile strength of the steel. A preferable content for Nickel for the present invention may be kept between 16% and 24% and more preferably between 16% and 22%.

Cobalt is an essential element for the steel of the present invention and is present between 6% and 12%. The purpose of adding cobalt is to assist the formation of reverted austenite during tempering thereby imparting elongation to the steel. Additionally, cobalt also helps in forming the inter-metallics of molybdenum by decreasing the rate molybendum to form solid solution. But when Cobalt is present more than 12% it forms reverted austenite in excess which is detrimental for the strength of the steel whereas as if cobalt is less than 6% it will not decrease the rate of solid solution formation. A preferable content for Cobalt for the present invention may be kept between 6% and 11% and more preferably between 7% and 10%.

Molybdenum is an essential element that constitutes 2% to 6% of the Steel of the present invention; Molybdenum increases the strength of the steel of the present invention by forming inter-metallics with Nickel and titanium during the heating for tempering. Molybdenum is an essential element for imparting the corrosion resistance properties to the steel of the present invention. However, the addition of Molybdenum excessively increases the cost of the addition of alloy elements, so that for economic reasons its content is limited to 6%. Preferable limit for molybdenum is between 3% and 6% and more preferably between 3.5% and 5.5%.

Titanium content of the steel of the present invention is between 0.1% and 1%. Titanium forms inter-metallic as well as carbides to impart strength to the steel. If titanium is less than 0.1% the requisite effect is not achieved. A preferable content for the present invention may be kept between 0.1% and 0.9% and more preferably between 0.2% and 0.8%.

Carbon is present in the steel between 0.0001% and 0.03%. Carbon is a residual element and comes from processing. Impurity Carbon below 0.0001% is not possible due to process limitation and presence of Carbon above 0.03 must be avoided as it decreases the corrosion resistance of the steel.

Phosphorus constituent of the steel of the present invention is between 0.002% and 0.02%. Phosphorus reduces the spot weldability and the hot ductility, particularly due to its tendency to segregate at the grain boundaries or co-segregation. For these reasons, its content is limited to 0.02% and preferably lower than 0.015%.

Sulfur is not an essential element but may be contained as an impurity in steel and from point of view of the present invention the Sulfur content is preferably as low as possible, but is 0.005% or less from the viewpoint of manufacturing cost. Further if higher Sulfur is present in steel it combines to form Sulfides and reduces its beneficial impact on the steel of the present invention, therefore a preferred content is below 0.003%

Nitrogen is limited to 0.01% in order to avoid ageing of material, nitrogen forms the nitrides which impart strength to the steel of the present invention by precipitation strengthening with Vanadium and Niobium but whenever the presence of nitrogen is more than 0.01% it can form high amount of Aluminum Nitrides which are detrimental for the present invention hence the preferable upper limit for nitrogen is 0.005%.

Aluminum is not an essential element but may be contained as a processing impurity in steel due to the fact that aluminum is added in the molten state of the steel to clean the steel of the present invention by removing oxygen existing in molten steel to prevent oxygen from forming a gas phase hence may be present up to 0.1% as a residual element. But from the point of view of the present invention the Aluminum content is preferably as low as possible.

Niobium is an optional element for the present invention. Niobium content may be present in the steel of the present invention between 0% and 0.1% and is added in the steel of the present invention for forming carbides or carbo-nitrides to impart strength to the steel of the present invention by precipitation strengthening.

Vanadium is an optional element that constitutes between 0% and 0.3% of the steel of the present invention. Vanadium is effective in enhancing the strength of steel by forming carbides, nitrides or carbo-nitrides and the upper limit is 0.3% due to the economic reasons. These carbides, nitrides or carbo-nitrides are formed during the second and third step of cooling. Preferable limit for Vanadium is between 0% and 0.2%.

Copper may be added as an optional element in an amount of 0% to 0.5% to increase the strength of the steel and to improve its corrosion resistance. A minimum of 0.01% of Copper is required to get such effect. However, when its content is above 0.5%, it can degrade the surface aspects.

Chromium is an optional element for the present invention. Chromium content may be present in the steel of the present invention is between 0% and 0.5%. Chromium is an element that improves the corrosion resistance to the steel but higher content of Chromium higher than 0.5% leads to central co-segregation after casting.

Other elements such as, Boron or Magnesium can be added individually or in combination in the following proportions by weight: Boron≤0.001%, Magnesium≤0.0010%. Up to the maximum content levels indicated, these elements make it possible to refine the grain during solidification.

The remainder of the composition of the Steel consists of iron and inevitable impurities resulting from processing.

The microstructure of the Steel comprises:

Reverted Austenite is the matrix phase of the steel of the present invention and is present at least 60% by area fraction. The Reverted austenite of the present steel is enriched with nickel that is the reverted austenite of the present steel contains higher amount of Nickel in comparison to residual austenite. The reverted austenite is formed during the tempering of the steel and also gets enriched with Nickel simultaneously. The reverted austenite of the steel of the present invention imparts both elongation as well as corrosion resistance against the sour environment. Martensite is present in the steel of the present invention between 20% and 40% by area fraction. The martensite of the present invention includes both Fresh Martensite and Tempered martensite. Fresh martensite is formed during the cooling after annealing and gets tempered during the tempering step. Martensite imparts the steel of the present invention with both elongation as well as the strength.

Inter-metallic compounds of Nickel, Titanium and Molybdenum are present in the steel of the present invention. The inter-metallic compounds are formed during the heating as well as during the tempering process. Inter-metallic compounds formed are both inter-granular as well as intra-granular inter-metallic compounds. Inter granular Inter-metallic compounds of the present invention are present in both Martensite and Reverted Austenite. These inter-metallic compounds of present invention can be cylindrical or globular in shape. Inter-metallic compounds of the steel of the present invention are in formed as Ni3Ti, Ni3Mo or Ni3(Ti, Mo) inter-metallic compounds. Inter-metallic compounds of the steel of the present invention impart imparts the steel of the present invention with strength and corrosion resistance especially against the sour environment.

In addition to the above-mentioned microstructure, the microstructure of the hot rolled steel sheet is free from microstructural components, such as Ferrite, Bainite, Pearlite and Cementite but may be found in traces. Even the traces of inter-metallic compound if Iron such as Iron-Molybdenum and Iron Nickel may be present but the presence of inter-metallic compounds of iron have no significant influence over the in-use properties of the steel.

The steel of the present invention can be formed in to seamless tubular product or steel sheet or even a structural or operational part to be used in oil and gas industry or any other industry having a sour environment. In a preferred embodiment for the illustration of the invention a steel sheet according to the invention can be produced by the following method. A preferred method consists in providing a semi-finished casting of steel with a chemical composition according to the invention. The casting can be done either into ingots, billets, bars or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation. The slab provided by continuous casting process can be used directly at a high temperature after the continuous casting or may be first cooled to room temperature and then reheated for hot rolling.

The temperature of the slab, which is subjected to hot rolling, is preferably at least 1150° C. and must be below 1300° C. In case the temperature of the slab is lower than 1150° C., excessive load is imposed on a rolling mill. Therefore, the temperature of the slab is preferably sufficiently high so that hot rolling can be completed in the in 100% austenitic range. Reheating at temperatures above 1275° C. causes productivity loss and is also industrially expensive. Therefore, the preferred reheating temperature is between 1150° C. and 1275° C.

Hot rolling finishing temperature for the present invention is between 800° C. and 975° C. and preferably between 800° C. and 950° C.

Then the method includes cooling the hot rolled steel strip obtained in this manner from hot roll finishing temperature to a temperature range between 10° C. and Ms. The preferable temperature range for cooling the hot rolled steel strip is between 15° C. and Ms-20° C.

Thereafter the method includes heating the hot rolled steel strip to an annealing temperature range between Ae3 and Ae3+350° C. The hot rolled steel strip is held at the annealing temperature for a duration greater than 30 minutes. In a preferred embodiment, the annealing temperature range is between Ae3+20° C. and Ae3+350° C. and more preferably between Ae3+40° C. and Ae3+300° C.

Then the hot rolled steel strip is cooled at a cooling rate between 1ºC/s and 100° C./s In a preferred embodiment, the cooling rate for cooling after holding at annealing temperature is between 1° C./s and 80° C./s and more preferably between 1° C./s and 50° C./s. The hot rolled steel strip is cooled to temperature range between 10° C. and Ms after annealing and preferably between 15° C. and Ms-20° C. During this cooling step the fresh Martensite is formed and the cooling rate above of 1ºC/s ensures that the hot rolled strip is completely martenstic in nature.

Then the hot rolled steel strip is heated to the tempering temperature range at a heating rate between 0.1° C./s and 100° C./s, preferably between 0.1° C./s and 50° C./s, an even between 0.1° C./s and 30° C./s. During this heating as well as during tempering inter-metallic of Nickel, Titanium and Molybdenum are formed. Inter-metallic compounds formed during this heating and tempering are both intra-granular as well as intergranular which forms as Ni3Ti, Ni3Mo or Ni3(Ti, Mo) inter-metallic compounds. The tempering temperature range is between 575° C. and 700° C. where the steel is tempered for a duration between 30 minutes and 72 hours. In a preferred embodiment the tempering temperature range is between 575° C. and 675° C. and more preferably between 590° C. and 660° C. During the tempering holding the martensite is reverted to Austenite to form reverted austenite. The reverted austenite formed during tempering is enriched with nickel due to the reason that in tempering temperature range of present invention some of the intermetallic formed during heating dissolves and enriches the austenite with nickel and this nickel enriched reverted austenite is stable at room temperature.

There after the hot rolled steel strip is cooled to room temperature to obtain the hot rolled steel.

EXAMPLES

The following tests, examples, figurative exemplification and tables which are presented herein are non-restricting in nature and must be considered for purposes of illustration only, and will display the advantageous features of the present invention.

Steels of different compositions are gathered in Table 1, where the steel are produced according to process parameters as stipulated in Table 2, respectively. Thereafter Table 3 gathers the microstructures of the steel obtained during the trials and table 4 gathers the result of evaluations of obtained properties.

TABLE 1

| Steel Samples | C | Ni | Co | Mo | Al | Ti | V | P | S | N | Nb | Cu | Cr |
|---|---|---|---|---|---|---|---|---|---|---|---|---|---|
| 1 | 0.0029 | 17.530 | 8.76 | 4.86 | 0.0354 | 0.5217 | 0.0177 | 0.0042 | 0.006 | 0.0016 | 0.0141 | 0.0309 | 0.0530 |
| 2 | 0.0052 | 18.043 | 8.98 | 5.245 | 0.01 | 0.507 | 0.067 | 0.0042 | 0.0045 | 0.0015 | 0 | 0 | 0 |
| 3 | 0.0024 | 13.986 | 9.05 | 4.86 | 0.0380 | 0.4580 | 0.0740 | 0.0038 | 0.0041 | 0.0015 | 0.277 | 0.0350 | 0 |

underlined values: not according to the invention.

TABLE 2

Table 2

| Steel Sample | Trials | Reheating temperature (° C.) | HR Finish temperature (° C.) | HR cooling temperature (° C.) | Annealing temperature (° C.) | Annealing time (s) | Cooling rate (° C./s) | Cooling temperature (° C.) |
|---|---|---|---|---|---|---|---|---|
| 1 | I1 | 1200 | 850 | 20 | 1020 | 1800 | 30 | 20 |
| 1 | I2 | 1200 | 850 | 20 | 800 | 1800 | 30 | 20 |
| 2 | I3 | 1200 | 850 | 20 | 850 | 1800 | 30 | 20 |
| 1 | R1 | 1200 | 850 | 20 | 800 | 1800 | 30 | 20 |
| 2 | R2 | 1200 | 850 | 20 | 850 | 1800 | 30 | 20 |
| 3 | R3 | 1200 | 850 | 20 | 850 | 1800 | 30 | 20 |

| Steel Sample | Heating rate to tempering (° C./s) | Tempering temperature (° C.) | Tempering time (s) | Ae3 | Ms |
|---|---|---|---|---|---|
| 1 | 15 | 600 | 86400 | 756 | 558 |
| 1 | 15 | 650 | 3600 | 756 | 558 |
| 2 | 15 | 650 | 3600 | 761 | 552 |

TABLE 2-continued

Table 2

| | | | | | |
|---|---|---|---|---|---|
| 1 | 15 | 550 | 1 | 756 | 558 |
| 2 | 15 | 500 | 300 | 761 | 552 |
| 3 | 15 | 500 | 300 | 894 | 620 |

Table 2 gathers the process parameters implemented on steels of Table 1.

Ms for all the steels samples is calculated in accordance of the following formula:

Ms = 764.2 − 302.6 C − 30.6 Mn − 16.6 Ni − 8.9 Cr + 2.4 Mo − 11.3 Cu + 8.58 Co + 7.4 W − 14.5 Si, wherein the elements contents are expressed in weight percent Whereas the Ae3 is calculated in (° C.) in accordance of the following formula:

Ae3 = 955-350 C − 25 Mn + 51 Si + 106 Nb + 100 Ti + 68 Al − 11 Cr − 33 Ni − 16 Cu + 67 Mo, wherein the elements contents are expressed in weight percent I = according to the invention;

R = reference;

underlined values: not according to the invention.

Table 3 exemplifies the results of the tests conducted in accordance with the standards on different microscopes such as Scanning Electron Microscope for determining the microstructures of both the inventive and reference steels.

The results are stipulated herein:

TABLE 3

| Steel Sample | Trials | Reverted Austenite (%) | Martensite (%) | Inter-metallic compounds |
|---|---|---|---|---|
| 1 | I1 | 64 | 36 | Yes |
| 1 | I2 | 75 | 25 | Yes |
| 2 | I3 | 70 | 30 | Yes |
| 1 | R1 | 3 | 97 | Yes |
| 2 | R2 | 3 | 97 | Yes |
| 3 | R3 | 3 | 97 | Yes |

I = according to the invention; R = reference; underlined values: not according to the invention.

Table 4 exemplifies the mechanical properties of both the inventive steel and reference steels. In order to determine the tensile strength, yield strength and total elongation, tensile tests are conducted in accordance of NBN EN ISO 6892-1 standards on a A25ype sample and the corrosion resistance test is conducted according to NACE TM0316 by method B with a load of at least 85% of yield strength.

The results of the various mechanical tests conducted in accordance to the standards are gathered

TABLE 4

| Steel Sample | Trials | Tensile Strength (MPa) | Yield Strength (MPa) | Total Elongation (%) | Sour Corrosion resistance (%) |
|---|---|---|---|---|---|
| 1 | I1 | 1312 | 1009 | 19 | No Crack -OK |
| 1 | I2 | 1204 | 899 | 22.8 | No Crack -OK |
| 2 | I3 | 1273 | 997 | 24 | No Crack -OK |
| 1 | R1 | 1477 | 1407 | 13.5 | Crack -Not OK |
| 2 | R2 | 1550 | 1442 | 13.1 | Crack -Not OK |
| 3 | R3 | 1416 | 1352 | 16.8 | Crack -Not OK |

I = according to the invention; R = reference; underlined values: not according to the invention.

The invention claimed is:

1. A hot rolled steel having a composition comprising the following elements, expressed in percentage by weight:

15%≤nickel≤25%

6%≤cobalt≤12%

2%≤molybdenum≤6%

0.1%≤titanium≤1%

0.0001%≤carbon≤0.03%

0.002%≤phosphorus≤0.02%

0%≤sulfur≤0.005%

0%≤nitrogen≤0.01% and optionally one or more of the following elements:

0%≤aluminum≤0.1%

0%≤niobium≤0.1%

0%≤vanadium≤0.3%

0%≤copper≤0.5%

0%≤chromium≤0.5%

0%≤boron≤0.001%

0%≤magnesium≤0.0010% a remainder of the composition being composed of iron and unavoidable impurities caused by processing;

a microstructure of the steel comprising in area fraction, 20% to 40% tempered martensite, at least 60% of reverted austenite and inter-metallic compounds of molybdenum, titanium and nickel.

2. The hot rolled steel as recited in claim 1, wherein the composition includes 16% to 24% of Nickel.

3. The hot rolled steel as recited in claim 1, wherein the composition includes 16% to 22% of Nickel.

4. The hot rolled steel as recited in claim 1, wherein the composition includes 6% to 11% of Cobalt.

5. The hot rolled steel as recited in claim 1, wherein the composition includes 7% to 10 of cobalt.

6. The hot rolled steel as recited in claim 1, wherein the composition includes 3% to 6% of molybdenum.

7. The hot rolled steel as recited in claim 1, wherein the composition includes 3.5% to 5.5% of molybdenum.

8. The hot rolled steel as recited in claim 1, wherein the composition includes 0.1% to 0.9% titanium.

9. The hot rolled steel as recited in claim 1, wherein the composition includes 0.2% to 0.8% of titanium.

10. The hot rolled steel as recited in claim 1, wherein the inter-metallic compounds of molybdenum, titanium and nickel are at least one or more from the group consisting of: $Ni_3Ti$, $Ni_3Mo$, and $Ni_3(Ti, Mo)$.

11. The hot rolled steel as recited in claim 1, wherein the inter-metallic compounds of molybdenum, titanium and nickel includes inter-granular and intra-granular inter-metallic compounds.

12. The hot rolled steel as recited in claim 1, wherein the steel has a tensile strength of 1100 MPa or more and a total elongation of 18% or more.

13. The hot rolled steel as recited in claim 1, wherein said steel has a tensile strength of 1200 MPa or more and a total elongation of 19% or more.

14. A method of production of a hot rolled steel comprising the following successive steps:

providing a semi-finished product having a composition comprising the following elements, expressed in percentage by weight:

15%≤nickel≤25%

6%≤cobalt≤12%

2%≤molybdenum≤6%
0.1%≤titanium≤1%
0.0001%≤carbon≤0.03%
0.002%≤phosphorus≤0.02%
0%≤sulfur≤0.005%
0%≤nitrogen≤0.01%
0%≤aluminum≤0.1%
0%≤niobium≤0.1%
0%≤vanadium≤0.3%
0%≤copper≤0.5%
0%≤chromium≤0.5%
0%≤boron≤0.001%
0%≤magnesium≤0.0010% a remainder of the composition being composed of iron and unavoidable impurities caused by processing;

reheating the semi-finished product to a temperature between 1150° C. and 1300° C.;

rolling the semi-finished product in the austenitic range wherein the hot rolling finishing temperature is between 800° C. and 975° C. to obtain a hot rolled steel strip;

then cooling the hot rolled steel strip to a temperature range between 10° C. and Ms;

thereafter reheating the hot rolled steel strip to an annealing temperature between $Ae_3$ and $Ae_3$+350° C., holding the hot rolled steel strip at such temperature for more than 30 minutes and cooling the hot rolled steel strip at a rate between 1°C/s and 100° C./s to temperature range between 10° C. and Ms;

thereafter reheating the hot rolled steel strip to a tempering temperature range between 575° C. and 700° C. with a heating rate between 0.1° C./s and 100° C./s and holding the hot rolled steel strip in the tempering temperature range for a duration between 30 minutes and 72 hours; and then cooling the hot rolled steel strip to room temperature to obtain the hot rolled steel as recited in claim 1.

15. The method as recited in claim 14, wherein the reheating temperature for semi-finished product is between 1150° C. and 1275° C.

16. The method as recited in claim 14, wherein the hot rolling finishing temperature is between 800° C. and 950° C.

17. The method as recited in claim 14, wherein the cooling temperature range for hot rolled strip after finishing hot rolling is between 15° C. and Ms-20° C.

18. The method as recited in claim 14, wherein the annealing temperature range is between $Ae_3$+20° C. and $Ae_3$+350° C.

19. The method as recited in claim 18, wherein the annealing temperature range is between $Ae_3$+40° C. and $Ae_3$+300° C.

20. The method as recited in claim 14, wherein the cooling rate after annealing is between 1°C/s and 80° C./s.

21. The method as recited in claim 20, wherein the cooling rate after annealing is between 1° C./s and 50° C./s.

22. The method as recited in claim 14, wherein the cooling temperature range after annealing is between 15° C. and Ms-20° C.

23. The method as recited in claim 14, wherein the tempering temperature range is between 575° C. and 675° C.

24. The method as recited in claim 23, wherein the tempering temperature range is between 590° C. and 660° C.

25. The method as recited in claim 14, wherein the heating rate for tempering is between 0.1°C/s and 50° C./s.

26. The method as recited in claim 25, wherein the heating rate for tempering is between 0.1° C./s and 30° C./s.

27. A method for manufacturing structural or operational parts for oil and gas wells comprising using the steel as recited in claim 1.

* * * * *